US007503731B2

(12) United States Patent
Seegmiller

(10) Patent No.: US 7,503,731 B2
(45) Date of Patent: Mar. 17, 2009

(54) YIELDABLE PROP FOR ROOF AND GROUND CONTROL

(76) Inventor: Ben L. Seegmiller, 143 S. 400 East, Salt Lake City, UT (US) 84111

( * ) Notice: Subject to any disclaimer, the term of this patent is extended or adjusted under 35 U.S.C. 154(b) by 90 days.

(21) Appl. No.: 11/013,706

(22) Filed: Dec. 16, 2004

(65) Prior Publication Data

US 2006/0133899 A1 Jun. 22, 2006

(51) Int. Cl.
*E21D 15/00* (2006.01)

(52) U.S. Cl. ..... 405/290; 405/288

(58) Field of Classification Search ..... 405/288, 405/290, 294
See application file for complete search history.

(56) References Cited

U.S. PATENT DOCUMENTS 2,532,168 A * 11/1950 Jakoubek ..... 405/290
5,015,125 A * 5/1991 Seegmiller ..... 405/288
5,215,411 A * 6/1993 Seegmiller ..... 405/290
5,228,810 A * 7/1993 Seegmiller ..... 405/290
5,400,994 A * 3/1995 Shawwaf et al. ..... 405/290
5,538,364 A * 7/1996 Huntsman ..... 405/288
5,564,867 A * 10/1996 Domanski et al. ..... 405/290
5,967,702 A * 10/1999 Vogelzang ..... 405/290

* cited by examiner

*Primary Examiner*—Frederick L Lagman
(74) *Attorney, Agent, or Firm*—Todd E. Zenger; Kirton & McConkie

(57) ABSTRACT

The present invention is directed to a yieldable prop to resist a sagging roof or thrusting floor. The invention is directed to a support apparatus disposed between the floor and the roof. The apparatus comprises a load-bearing member having a length with an axis along the length and having repeating surface undulations along at least a portion of its length. The load-bearing member is capable of moving in the direction of its axis. The apparatus also comprises a resistance member positioned adjacent a portion of length of the load-bearing member. The resistance member resists movement of the load-bearing member by incrementally deforming the undulations on the surface of the load-bearing member adjacent the resistance member as the load-bearing member moves axially.

9 Claims, 4 Drawing Sheets

YIELDABLE PROP FOR ROOF AND GROUND CONTROL

BACKGROUND

1. Field of the Invention

The present invention relates to roof and ground support apparatus and systems. Particularly, the present invention provides a cost-effective and disposable device to facilitate ground and roof control. This invention may be combined with a vehicle for transporting the yieldable props and for placing them.

2. Background of the Invention and Related Art

The present invention relates to a novel apparatus for providing roof and ground control in places such as mines, underground cavities, or any other place in which roof and floor are creeping together.

Different types of ground and roof control devices/props are known including those in U.S. Pat. Nos. 5,015,125, 5,215,411, 5,228,810, and the patents cited therein. U.S. Pat. Nos. 5,015,125, 5,215,411 and 5,228,810 rely on frictional forces between adjacent, tubular, overlapping telescoping members.

Other prior art systems include the installation of vertical timber posts or pairs of timber lengths stacked horizontally in quadratures, one pair on top of another. Devices known as doughnut cribbing comprising a series of vertically stacked reinforced concrete discs. All these support systems are used in underground mines at track turnout areas, track entry intersections, tailgate entries, at head gates, in mine drift tunnels and openings and at or near the mine face where excavation is occurring.

All of these systems do provide some yield. Some are costly and require significant transportation and installation costs. Others bear loads to a certain extent and then ultimately fail. Those constructed of wood have bearing strengths depending upon the nature of the wood and wood moisture.

Still other devices incorporate steel columns utilizing telescoping posts which provide varying load capabilities and yield, but are typically expensive.

Other types of yieldable roof support include roof mine bolts and associated brackets and nuts. When, for example, a mine roof begins to sag due to excavation, roof bolts, inserted into the roof of the mine tunnel to help support sections of the roof, are put under tensile stress. Due to Poission's ratio, the roof bolts are stretched slightly thinner. Depending upon the nature of the threads of the bolt, and any attached nuts or bearing plates or brackets, the bolt, its threads, any associated bearing plate or nuts, and their associated structures may deform permitting some yield to the sagging roof. In some cases, deformation of these devices results in the critical failure of the system with no additional support. DYWIDAG-Systems International USA, Inc. of Salt Lake City, Utah, has provided a nut with an inside thread diameter which changes from one end of the nut to the other end of the nut with receiving threads of correspondingly different depths relative to a roof bolt. This roof bolt nut permits incremental deformation or shearing of the roof bolt (a threaded bar) under load as the nut is pushed off the bolt, thus maintaining a resistive force against ceiling sag or floor thrust until the nut is pushed off the bolt.

BRIEF DESCRIPTION OF THE PRESENT INVENTION

The present invention is directed to a transportable, and if necessary or desired removable, and free-standing post or prop. The prop of the new invention comprises one or more substantially vertical load-bearing members, at least one of which is configured with continuous or non-continuous threads or repeated undulations along the surface of the load-bearing member(s). The new invention also comprises at least one resistance member for receiving the threads of the load-bearing member and under load incrementally deforming or shearing the threads of the load-bearing member received by the resistance member. The new invention further comprises a length adjustment mechanism which permits selection of the length of the prop upon installation in order to secure it between opposing roof and floor/ground surfaces.

The present invention may also include one or more housings or shrouds. The housings or shrouds may perform a number of functions, including but not limited to, supporting the resistance member and adjustment mechanism, providing a rigid post when the yield has progressed to a pre-determined length, provide support for a load-bearing member to prevent buckling, and other structural and functional advantages disclosed herein.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

Figure 1:
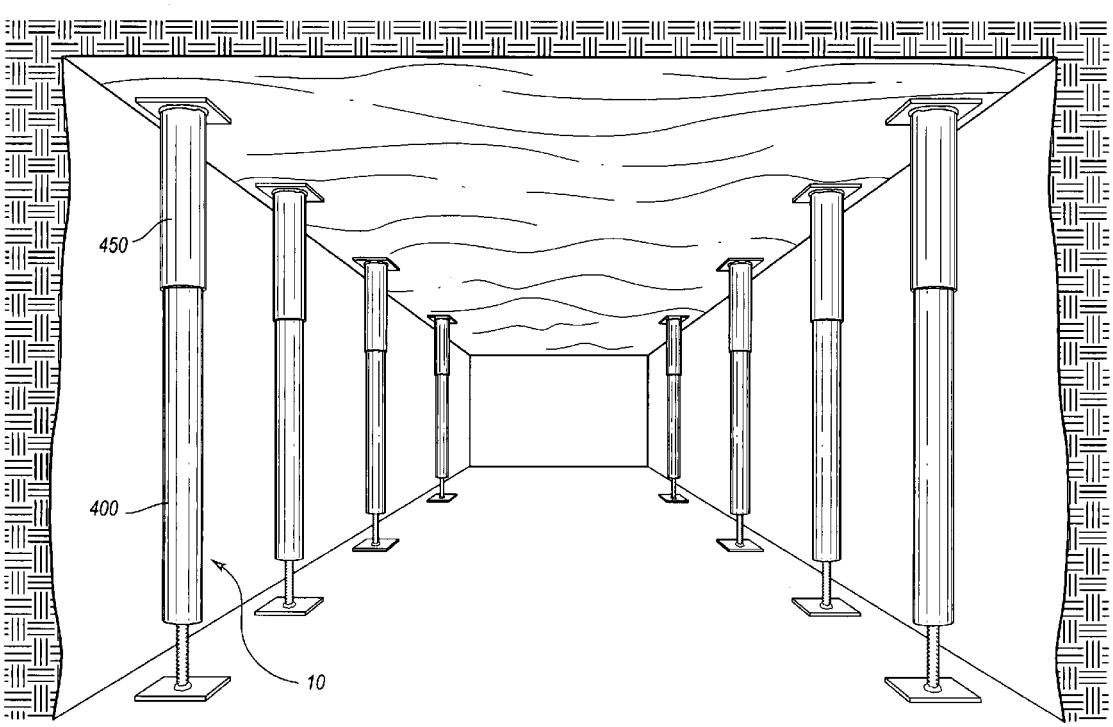
FIG. 1 depicts the application of one embodiment of the present invention.

It will be readily understood that the components of the present invention, as generally described and illustrated in the figures herein, could be arranged and designed in a wide variety of different configurations. Thus, the following more detailed description of the embodiments of the system and method of the present invention is not intended to limit the scope of the invention, as claimed, but is merely representative of the presently preferred embodiments of the invention.

The present invention does not rely upon friction between telescoping steel tubes or pipes as disclosed and claimed in U.S. Pat. Nos. 5,015,215, 5,215,411, and 5,228,810.

The present invention is directed to a yieldable post indicated generally as 10, it comprises one or more load-bearing members 100 deformed or sheared by one or more resistance members 200. The present invention may also include a height adjustment mechanism 300. Furthermore, the invention may include one or more housings or shrouds 400 and 450.

Load-bearing member 100 is contemplated to be a steel rod or bar having continuous or discontinuous threads or repeated undulations on the surface of member 100. One embodiment contemplates using DYWIDAG thread bar with discontinuous threads, that is there being one or more flat sides on the bar. Load-bearing member 100 adjacent the roof and is fixed relative to plate 110. Member 100 bears threads or undulations 120. The threads can be the standard threads provided by a vendor such as DYWIDAG-Systems International, Inc. The present invention contemplates either uniform or non-uniform threads or undulations, or either helical or separate outwardly extending rings on the surface of member 100. Load-bearing member 100 is received in shearing or resistance member 200.

Figure 3:
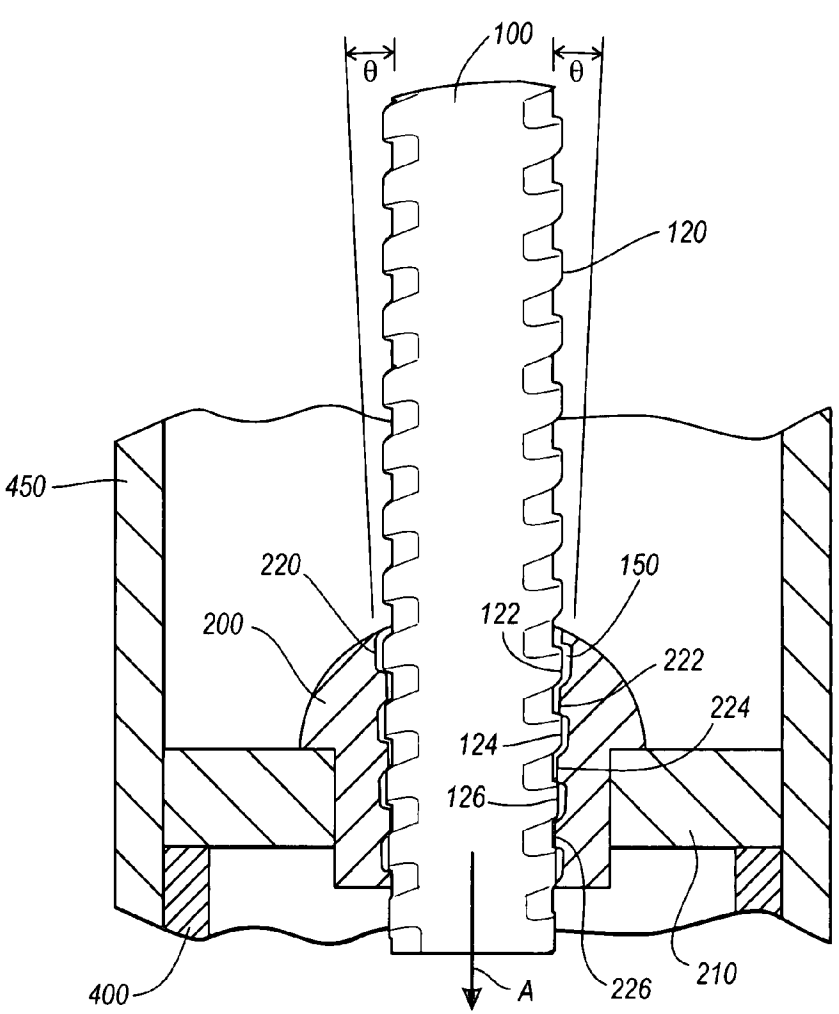
FIG. 3 depicts a cross-sectional view along line 3-3 of FIG. 2, illustrating incremental thread of the resistance member.
Figure 2:
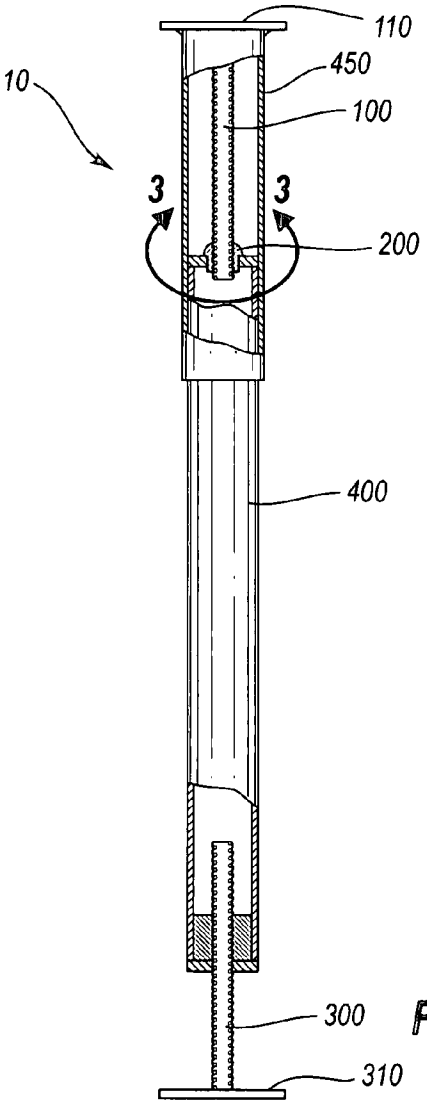
FIG. 2 depicts a breakaway view of one embodiment.

Shearing or resistance member 200 contemplates a nut-type device as shown in FIG. 3 adjacent support 210. In another embodiment, shearing member 200 can be a plate and can act without a support member 210. In any event, shearing member 200 comprises threads 220 to receive the load member threads 120. Resistance member 200 is adjacent the floor or ground.

Figure 5:
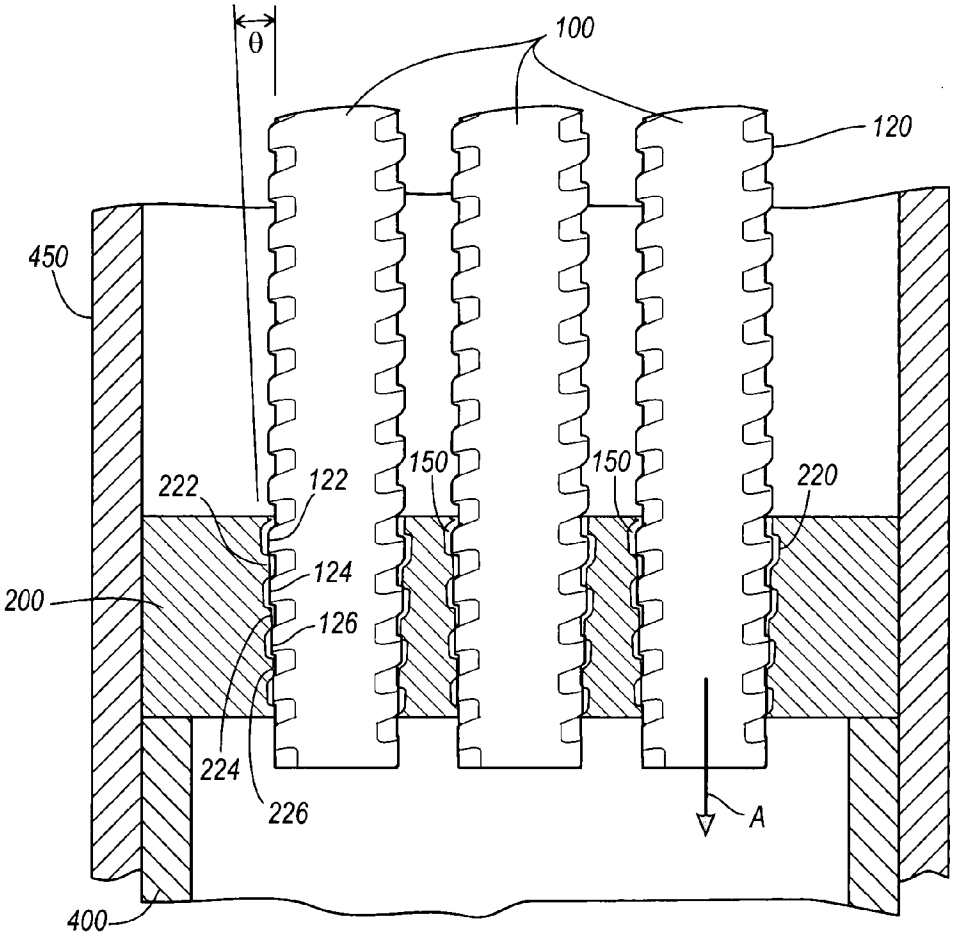
FIG. 5 depicts a cross-sectional view along line 5-5 of FIG. 4.
Figure 4:
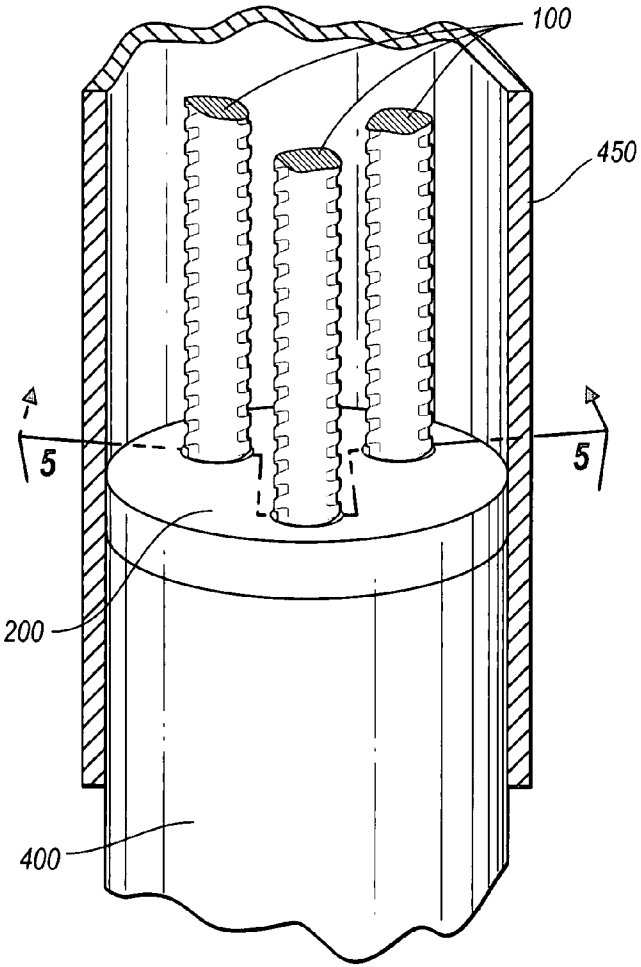
FIG. 4 depicts an alternative embodiment.

Threads 120 and receiving threads 220 are configured in an angular relationship, as shown in FIGS. 3 and 5, by an angle theta, θ. As contemplated by the present invention, the diameter of receiving threads 220 decreases within shearing member 200 in the direction A, shown in FIGS. 3 and 5. That is, the inside diameter of threads or cross-sectional area of threads 222 in FIG. 5 is greater than the inside diameter of receiving threads 224. Similarly, the inside diameter or cross-sectional area of receiving threads 224 is greater than the inside diameter of receiving threads 226. At the same time, the outside diameter of threads 120 of load-bearing member remain substantially the same. This configuration leaves a gap 150 between the threads of load-bearing member 100 and shearing member 200. This gap decreases in the direction of arrow A.

In this way, when load-bearing member 100 is put under compression from a sagging roof or thrusting floor, load-bearing member 100 will move axially in a direction of arrow A relative to shearing member 200. As load-bearing member 100 is forced against resistance member 200, only a small portion of threads 122 will be sheared off by receiving threads 222 due to gap 150. That is, the cross-sectional area of threads 122 is reduced. An additional portion of threads 124 would be sheared off by the receiving threads 224 because gap 150 is smaller. Further, a greater amount of threads 126 would be sheared off by receiving threads 226 as gap 150 is the smaller, and so on. In other words, the cross-sectional area of the load-bearing member is incrementally reduced.

This shearing action occurs because load-bearing member 100 is not twisted through shearing plate 200 in a conventional way that a threaded member passes through another member of receiving threads. The present invention contemplates a load forcing members 100 and resistance member 200 against each other without rotation of member 100 or member 200. As a result, the receiving threads 220 resist the motion of load-bearing members 100 until deformation of threads 120 of the load-bearing member 100. The present invention contemplates, therefore, that shearing member 200 be fabricated of a harder material or steel than load-bearing member(s) 100 so that load-bearing threads 120 shear or deform as load-bearing member 100 and resistance member 200 are pushed toward each other.

This configuration permits incremental shearing of load member 100, thereby avoiding any critical failure of load-bearing member 100. In other words, as load-bearing member 100 passes through shearing member 200, undeformed threads 120 enter into shearing member 200. As member 100 continues to be forced through member 200, a first or small portion of thread 120 is sheared off by receiving threads 220 due to gap 150. As such thread 120 is sheared and passes to the next receiving thread 220, it again encounters resistance because gap 150 has decreased. As thread 120 passes by a subsequent receiving thread 220 an additional portion of thread 120 is sheared off. Thread 120 then passes onto the next receiving thread 220 and again encounters resistance because gap 150 has again decreased. This incremental shearing or reduction of threads 120 provides for repeated resistance by resistance member 200 against the movement of load-bearing member 100, while at the same time, permitting a controlled yield of the post. As a result, there is no critical failure because resistance member 200 repeatedly resists load-bearing member 100 as it pushes through resistance member 200. This illustrates the need for load-bearing member 100 to be constructed of a material which deforms when encountering receiving threads 220.

Figure 6:
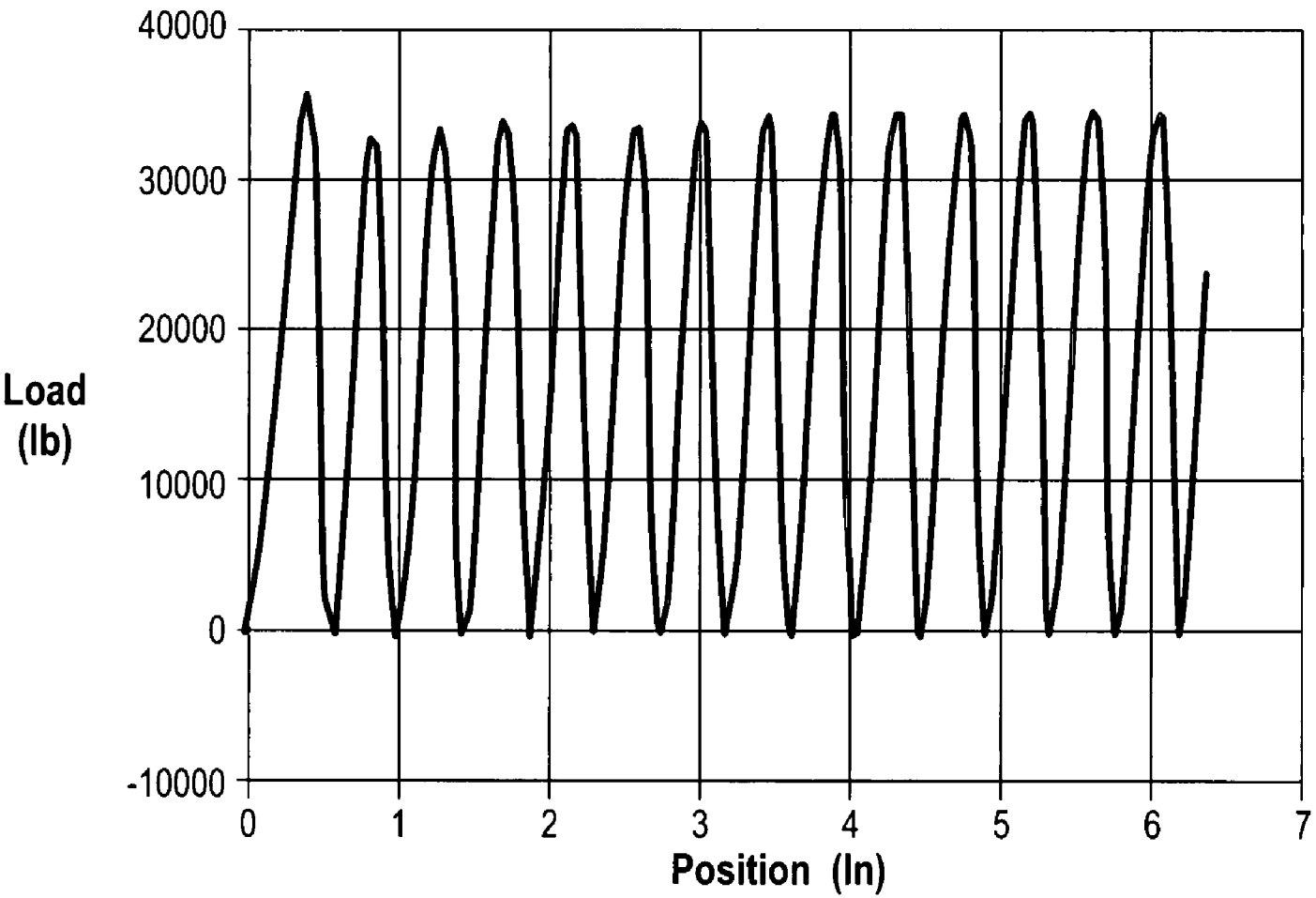
FIG. 6 depicts a load curve showing the repeating, incremental load-bearing capabilities of the present invention.

The repeated load-bearing capability of such a device is illustrated by the example in FIG. 6. The configuration similar to that illustrated in FIG. 3 was used to test the repeated or sustained load-bearing capability of a DYWIDAG number 7 thread bar in a DYWIDAG slip nut. DYWIDAG slip nuts have conventionally been used when a threaded roof bolt bar is in tension. However, in the present invention, load-bearing member 100 is in compression which further adds a slight increase in the diameter of member 100 further facilitating a resistance between member 100 and resistance member 200 under load, due to Poisson's ratio. FIG. 6 shows a load curve of a soft load test machine as the member 100 is forced through resistance member 200. The load begins at zero and continues to approximately 36,000 pounds or about 18 tons. As threads 120 are subject to the load, threads 120 incrementally deform and shear as they pass the corresponding set of receiving threads 220 yielding to the load. As threads 120 engage the next set of spaced receiving threads 220, resistance members again bear the load. This cycle is repeated as load-bearing member 100 is forced through resistance member 200. This provides for a yieldable post or prop until bearing plate 110 bears against resistance member 200 or support 210 to then form a rigid, non-yieldable post.

The present invention therefore permits a pre-determined or selected length of load-bearing member 100 to be chosen and positioned to meet the load-bearing requirements of the roof sag or floor thrust as deemed appropriate or desired by mine personnel.

An angular relationship of threads 120 of load-bearing member 100 and receiving threads 220 of resistance or shearing member 200 permits incremental shearing of threads 120 and repeated load-bearing capability of load-bearing member 100 over a pre-selected length of load-bearing member 100 without subjecting load-bearing member 100 to any critical failure which failure would allow it to pass through resistance member 200 without repeatedly bearing load. In this way, the post of the present invention over time repeatedly yields but repeatedly bears weight up to a substantially constant load.

Rather than using a single load-bearing member of FIG. 3, such as a number 7 DYWIDAG bar, a plurality of smaller bars could be used as shown in FIG. 5. As shown in FIG. 5, a similar angular relationship exists between threads 120 of the load-bearing member 100 and receiving threads 220 of the resistance or shearing member 200. In order to provide a yieldable mine post which will bear a desired load before yielding such as 20 or 25 tons, a person of ordinary skill in the art can without undue experimentation, vary the angular relationship θ, the relative hardnesses of the load-bearing member and the resistance member, thickness of the threaded bar, the number of threaded bars, the number of engaging threads, and the surface area of contact between threads 120 of the load-bearing member and threads 220 of the resistance member. By varying these parameters, the amount of load which can be borne by the mine posts can be adapted for the use, circumstances, and need of a particular application.

The present invention also contemplates the use of one or more shrouds. Shroud 400 can be used to support resistance member 200 and to facilitate height adjust mechanism 300 and plate 310, discussed below. Shroud 400 must be of sufficient strength and size to bear the intended loads.

Shroud 450 can be used to integrate or stiffen the structural connection and relationship of member(s) 100 and plate 110. Shroud 450 also prevents any objects from laterally striking or bending member(s) 100 which could result in buckling of member(s) 100. Shroud 450 may also limit any buckling of member 100.

The present invention also contemplates inverting the entire structure so the load-bearing member is adjacent the floor or ground while the resistance member is adjacent the roof.

The present invention may also incorporate a height adjustment mechanism 300. Plate 310 would engage a surface. Such mechanisms are disclosed in U.S. Pat. Nos. 5,215,411 and 5,228,810. The disclosure of and description of such height adjustment mechanisms of U.S. Pat. Nos. 5,215,411 and 5,228,810 are incorporated herein by express reference.

In addition, the present invention may include the use of a vehicle or device to place and position the mine post. Again with reference to U.S. Pat. No. 5,228,810, the disclosure and description of such a device, as illustrated in FIGS. 7, 8, 10 and 11, are incorporated herein by express reference.

What is claimed:

1. A support apparatus disposed between two surfaces, a floor and a roof, the apparatus comprising:

a load-bearing member, the load-bearing member adjacent one surface and having a length with an axis along the length and having cross-sectional areas substantially normal to the axis of the length, the load-bearing member capable of moving substantially axially; and a stationary resistance member and a support member therefor, the support member adjacent another surface, the resistance member positioned adjacent a portion of length of the load-bearing member, the resistance member providing a load resistance by incrementally reducing cross-sectional areas of the load-bearing member adjacent the resistance member as the load-bearing member moves axially.

2. The apparatus of claim 1 further comprising a height adjustment mechanism.

3. The apparatus of claim 1 further comprising a shroud disposed about the load-bearing member.

4. A support apparatus disposed between two surfaces, a floor and a roof, the apparatus comprising:

a load-bearing member, the load-bearing member adjacent one surface and having a length with an axis along the length and having threads along at least a portion of the length, the load-bearing member capable of moving substantially axially; and a stationary resistance member and a support member therefor, the support member adjacent another surface and the resistance member positioned adjacent a portion of the length of the load-bearing member having threads, the resistance member providing a load resistance by incrementally deforming the threads of the load-bearing member adjacent the resistance member as the load-bearing member moves axially.

5. The apparatus of claim 4 further comprising a height adjustment mechanism.

6. The apparatus of claim 4 further comprising a shroud disposed about the load-bearing member.

7. A support apparatus disposed between two surfaces, a floor and a roof, the apparatus comprising:

a load-bearing member, the load-bearing member adjacent one surface and having a length with an axis along the length and having repeating surface undulations along at least a portion of the length, the load-bearing member capable of moving substantially axially; and a stationary resistance member and a support member therefor, the support member adjacent another surface and the resistance member positioned adjacent a portion of the length of the load-bearing member having undulations, the resistance member providing a load resistance by incrementally deforming the undulations of the load-bearing member adjacent the resistance member as the load-bearing member moves axially.

8. The apparatus of claim 7 further comprising a height adjustment mechanism.

9. The apparatus of claim 7 further comprising a shroud disposed about the load-bearing member.

* * * * *